US006036564A

United States Patent [19]

Scholten et al.

[11] Patent Number: 6,036,564

[45] Date of Patent: Mar. 14, 2000

[54] METHOD AND DEVICE FOR INSPECTING AN ELECTRON GUN

[75] Inventors: Pieter Scholten, Eindhoven, Netherlands; Hector H. Velasco, Buenos Aires, Argentina

[73] Assignee: U.S. Philips Corporation, New York, N.Y.

[21] Appl. No.: 09/291,556

[22] Filed: Apr. 14, 1999

[30] Foreign Application Priority Data

Apr. 15, 1998 [EP] European Pat. Off. ..... 98201196

[51] Int. Cl.[7] ..... H01J 9/00

[52] U.S. Cl. ..... 445/4; 445/64

[58] Field of Search ..... 445/4, 64

[56] References Cited

U.S. PATENT DOCUMENTS 2,426,697 9/1947 Larson ..... 445/4

FOREIGN PATENT DOCUMENTS

0793250A1 9/1997 European Pat. Off. ..... H01J 9/18

*Primary Examiner*—Kenneth J. Ramsey
*Attorney, Agent, or Firm*—John C. Fox

[57] ABSTRACT

An assembly of electrodes for an electron is inspected. The relative positions of a number of apertures (at least three but preferably four) is determined by means of two optical systems, one for determining the positions of two apertures of electrodes, e.g. the G1 and the G2 electrode, the other for determining the position of the other aperture or apertures.

8 Claims, 6 Drawing Sheets

METHOD AND DEVICE FOR INSPECTING AN ELECTRON GUN

BACKGROUND OF THE INVENTION

The invention relates to a method of manufacturing a cathode ray tube comprising an electron gun having a number of electrodes with apertures for passing at least one electron beam, in which method during a method step an assembly of electrodes is inspected.

The invention also relates to a device for inspecting an assembly of electrodes.

Cathode ray tubes are used for instance in television apparatuses and computer monitors and oscilloscopes.

Such a method and device are known from European patent application EP 0 793 250. In the known method the position of an upper surface of a first electrode (G1) of an electrode assembly for an electron gun and the position of a lower surface of a second electrode (G2) are measured by means of electric micrometers. The first electrode is the so-called G1-electrode, i.e. the electrode closest to the cathode, when the cathode is installed in the gun. Although such an inspection may be useful, only a very limited inspection, namely of the position of two surfaces is possible. An electron gun may, for various reasons, not fulfil the quality requirements. Inspecting the assembly prior to assembling the electron gun as a whole makes it possible to selectively remove assemblies of electrodes from the manufacturing line, i.e. separate the "good" ones from the "faulty" ones. However, in the known method the risk that, after inspection, an electron gun does not fulfil the requirements is relatively high. The electrical fields which, in operation, form, steer and focus the electron beam(s) are to some extent dependent on the distance between the G1 and G2 electrodes but are also dependent on other parameters.

OBJECTS AND SUMMARY OF THE INVENTION

It is an object of the invention to provide an improved manufacturing method and an improved device for inspecting an assembly of electrodes.

To achieve this, the method in accordance with the invention is characterized in that the assembly of electrodes is positioned between a first and a second optical system and that the positions of a first and a second aperture of a first and a second electrode of the assembly are determined by means of the first optical system, and a position of a third aperture of a third electrode is determined by means of the second optical system.

The device in accordance with the invention is characterized in that the device comprises a holder for an assembly of electrodes between a first optical system for inspecting a first and a second aperture of an electron gun and a second optical system for inspecting a third aperture of an electron gun.

The electrical fields which, in operation, form, steer and focus the electron beam(s) are very sensitive to misalignment of apertures in the various electrodes and to errors in the form of the apertures. Misalignment and or deformation of an aperture will introduce an unwanted deviation or deformation of the electron beam(s).

The invention is based on the insight that, using an optical system it is possible to determine the position of the first and the second aperture. Although the second aperture is usually as large as, or larger than, the first aperture, the inventors have realized that, using an optical system, it is possible to look past the first aperture at the second aperture, so that the relative positions of the first and the second aperture can be determined. Using a second optical system, from the other side of the electron gun, the position of a third aperture can be determined. By determining the relative position of the first, second and third apertures, misalignments of these apertures in respect of ideal relative positions can be determined. Compared to the known method, more aspects of the electron gun, more in particular the relative positions of the apertures, can be distinguished. Furthermore the method is a non-contact method. Contact methods intrinsically hold the risk of damaging the apertures of the electrodes. Any damage to the apertures of the electrodes (such as scratches) would in itself form a potential source of electron beam deviation or deformation.

Preferably in the method according to the invention the position of a fourth aperture in a fourth electrode of the electron gun is determined by the second optical system. Determining the position of a fourth aperture further improves the discrimating power of the method.

Preferably the first optical system comprises two optical sub-systems, which two sub-systems have a lens system, positioned near the apertures and a partially transparent mirror in common, each optical sub-system further having a further lens system and a recording device to record an optical image of the relevant aperture.

This is a relatively simple set-up of the first optical system. The two sub-systems have a lens system (which could be a simple lens or a compound lens system, and preferably an achromatic lens) in common. Between the lens system and the recording devices there is a partially transparent mirror which separates two lights paths, one of the light path going through a first further lens system to a first recording device (for example a CCD camera), the other light path going through a second further lens system to a second recording device. By using different further lens systems in the two light paths, it is possible to have a different lens-object distance for the two light paths, one of the lights paths being focused on the first aperture, the other being focused on the second aperture.

Preferably the second optical system comprises two optical sub-systems, which two sub-systems have a lens system, facing the aperture(s), and a partially transparent mirror in common, each optical sub-system further having a further lens system and a recording device to record an optical image of the relevant aperture, so as to obtain the same advantages as described above.

Preferably the method comprises a first and a second recording step in which images of the relevant apertures are recorded by the recording devices, between which recording steps the assembly of electrodes is rotated, with respect to the optical systems, around an axis going approximately through the apertures. This enables to identify, in each of the images recorded by the recording devices, a common axis, i.e. a common rotational axis. This enables an increased accuracy in determining the relative positions of the apertures. The above described preferred embodiment can also, or in addition, be used for calibration of the relative positions of the recording devices. If this is the case the above embodiment can be used as an initialization step to determine the relative positions of the recording devices.

Preferably the assembly of electrodes is rotated through an angle of 180°.

Preferably the method comprises a step in which the assembly of electrodes is translated over a distance with respect to the optical systems, and images are recorded before and after the translation.

This enables to identify, in the images taken by the recording devices, the scale of the images, which enables an increased accuracy in determining the (relative) positions of the apertures. This method step can also be used as an initialization step in which the scales of the images taken by the recording devices are determined.

BRIEF DESCRIPTION OF THE DRAWINGS

These and other aspects of the invention will be described in greater detail by means of exemplary embodiments and with reference to the accompanying drawings, in which.

DESCRIPTION OF THE PREFERRED EMBODIMENTS

Figure 1:
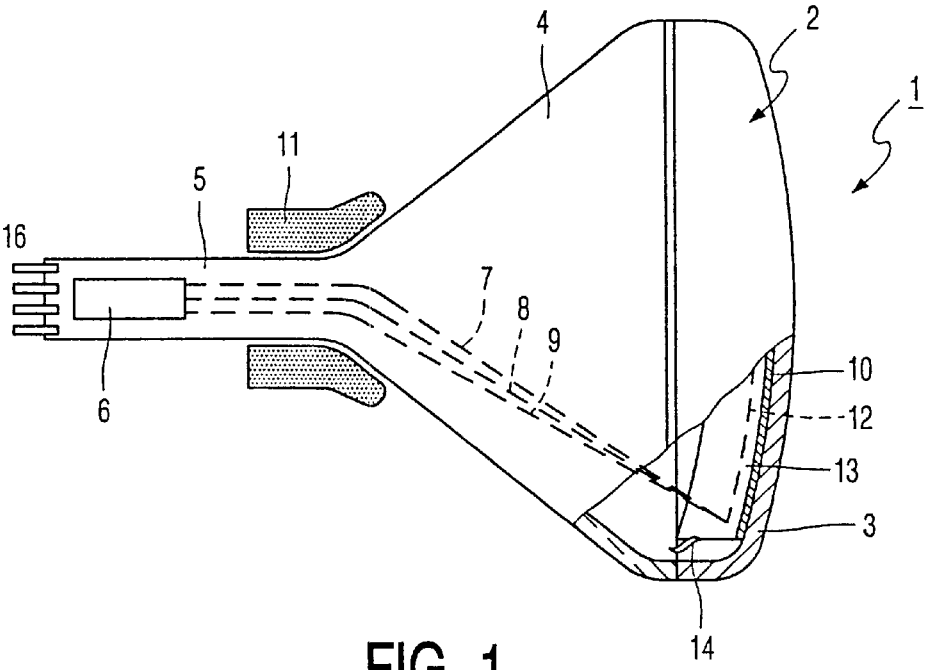
FIG. 1 is a sectional view of a cathode ray tube.

The Figures are not drawn to scale. In general, like reference numerals refer to like parts in the Figures.

FIG. 1 show a cathode ray tube, in this example a colour cathode ray tube 1, which comprises an evacuated envelope 2 consisting of a display window 3, a cone portion 4 and a neck 5. In said neck 5 an electron gun 6 is provided for generating three electron beams 7, 8 and 9 which extend in one plane, the in-line plane, which in this example is the plane of drawing. A display screen 10 is provided on the inside of the display window. Said display screen 10 comprises a large number of phosphor elements luminescing in red, green and blue. On their way to the display screen, the electron beams are deflected across the display screen 10 by means of an electromagnetic deflection unit 11 and pass through a colour selection electrode 12 which is arranged in front of the display window 3 and which comprises a thin plate having a large number of apertures 13. The colour selection electrode (sometimes also called "shadow mask") is suspended in the display window by means of suspension elements. The three electron beams 7, 8 and 9 pass through the apertures 13 of the colour selection electrode at a small angle with respect to each other and, consequently, each electron beam impinges on phosphor elements of only one colour. The cathode ray tube further comprises feedthroughs 16 through which in operation voltages are applied to electrodes of the electron gun.

Figure 2A:
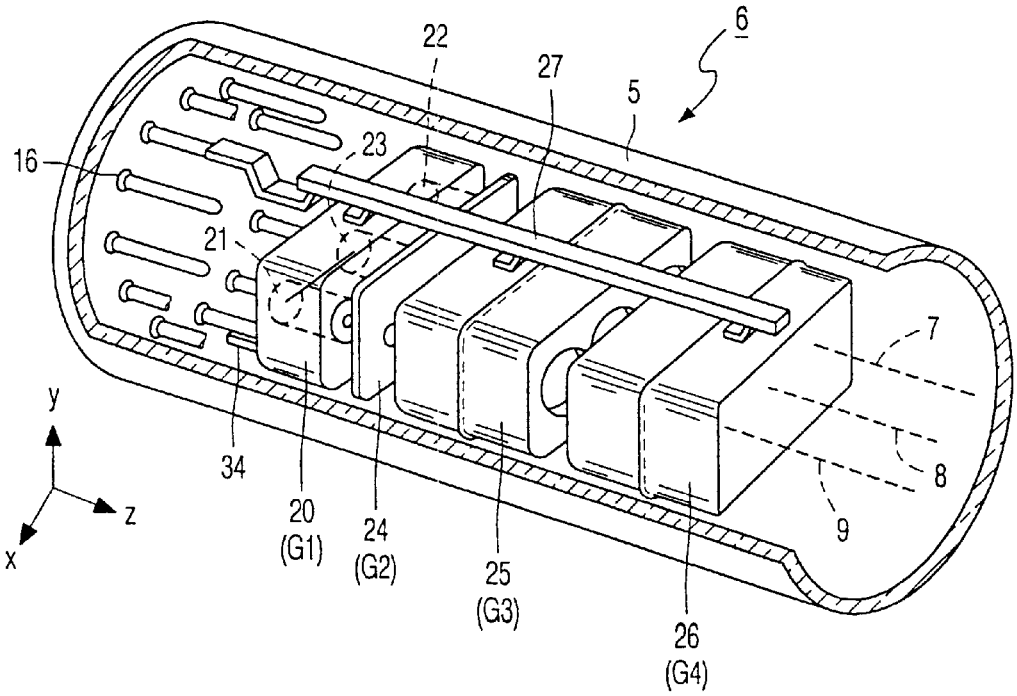
FIG. 2A is a perspective view of an electron gun.
Figure 2B:
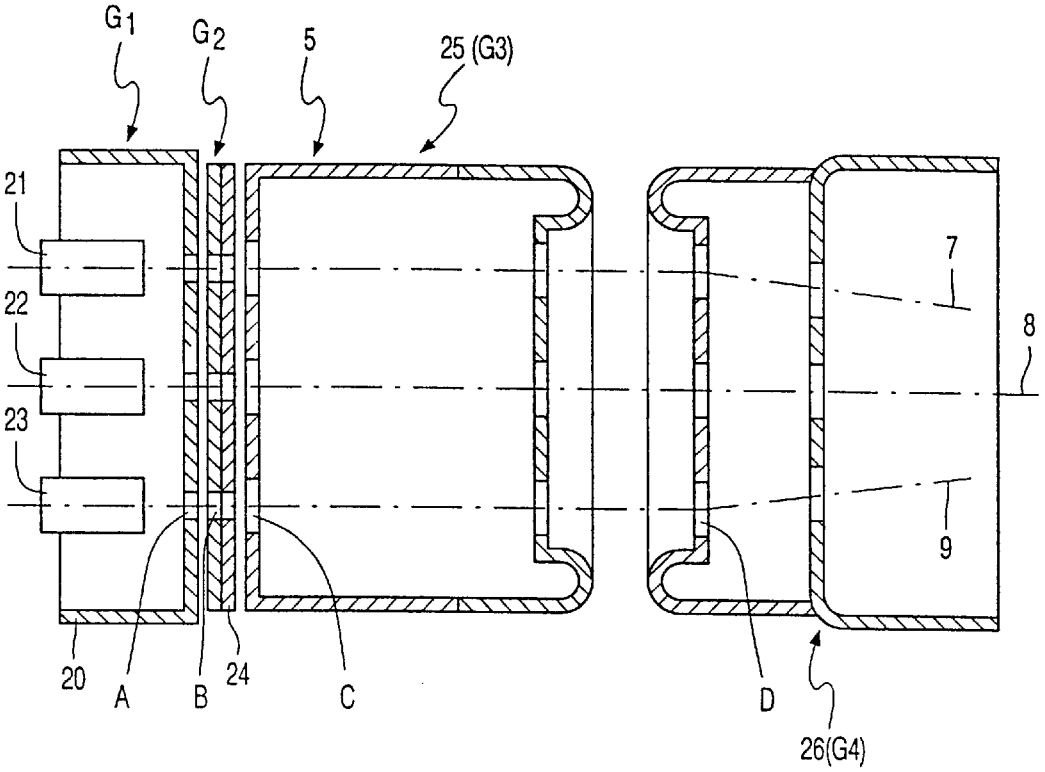
FIG. 2B is a sectional view of an electron gun showing an assembly of electrodes.

FIG. 2A is a partly perspective view of an electron gun 6. Said electron gun comprises, in this example, three cathodes 21, 22 and 23 (see FIG. 2B). Said electron gun 6 further comprises an assembly of electrodes having a first common electrode 20 (also referred to as the $G_1$-electrode), a second common electrode 24 ($G_2$-electrode), a third common electrode 25 ($G_3$-electrode) and a fourth common electrode 26 ($G_4$-electrode). The electrodes are mounted on supports 27 and have connections for applying voltages. By applying voltages and, in particular voltage differences between electrodes, electron-optical fields are generated in operation, which fields form, accelerate and focus the electron beams 7, 8 and 9. Between some electrodes astigmatic electron-optical elements are formed. Each of the electrodes have at least one, in this example three, apertures for passing the electron beams 7, 8 and 9. The electrode assembly comprising the electrodes (G1 to G4) and the supports 27 is made first, whereafter the cathodes and other parts are added to the assembly of electrodes to form an electron gun. The electrode assembly is sometimes also called "the beaded unit". The electron-optical quality of the electron gun is to a large extent influenced by the relative positions of the apertures through the electrode, in particular by the relative positions of apertures A, B, C and D.

Figure 3B:
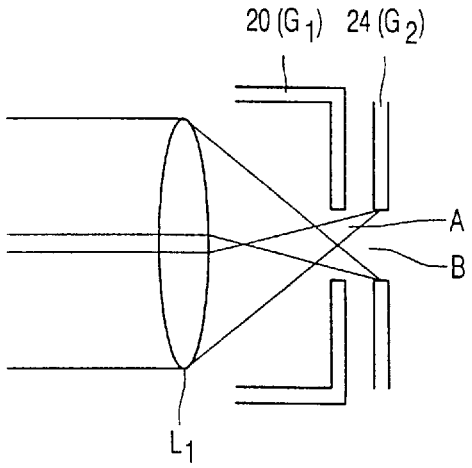
FIGS. 3A and 3B illustrate an embodiment of the method and device according to the invention.
Figure 3A:
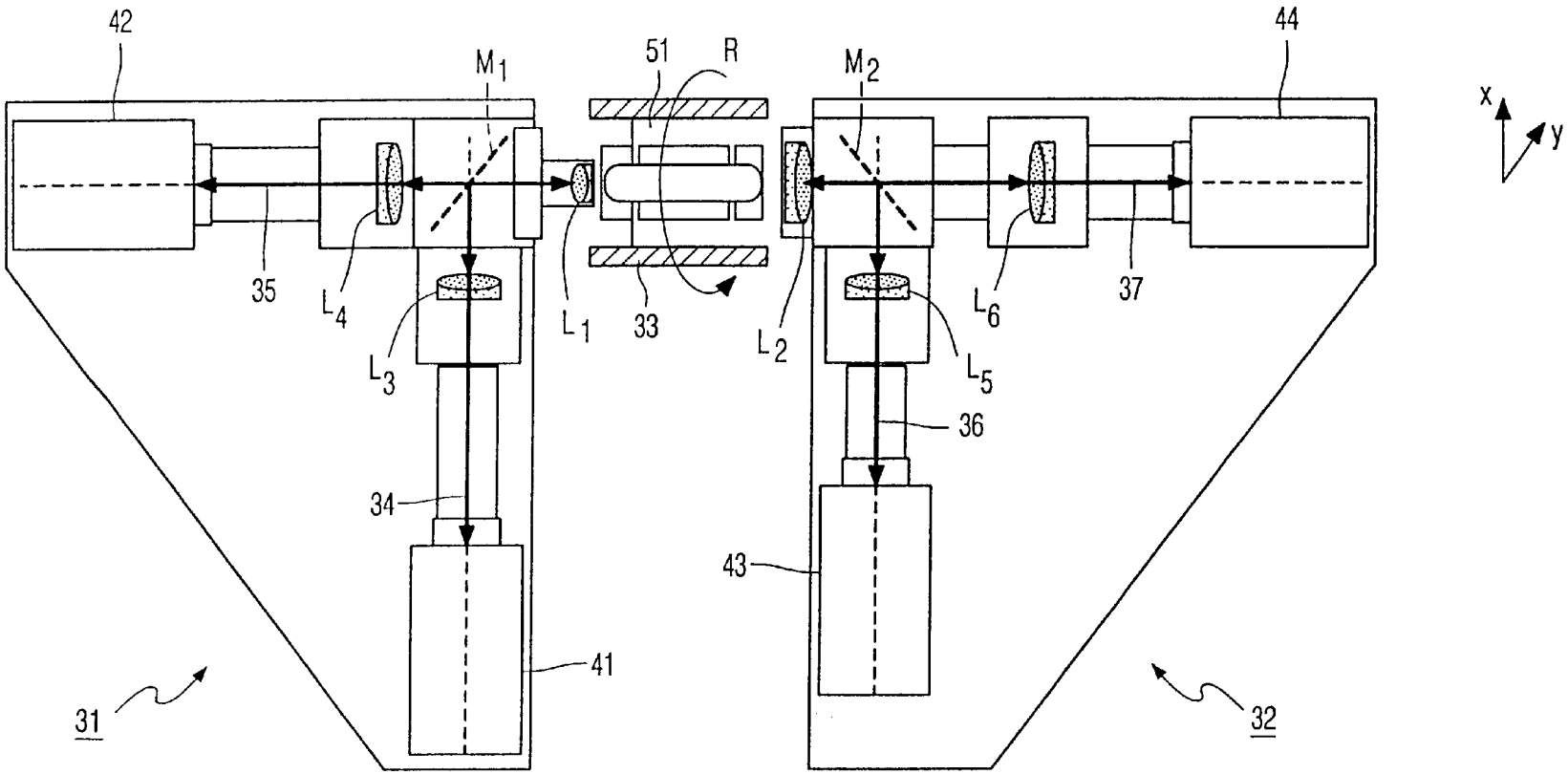

FIGS. 3A and 3B illustrate an embodiment of the invention and the device in accordance with the invention, wherein FIG. 3A shows the general set-up and FIG. 3B shows a detail. In between two optical systems 31, 32 an assembly of electrodes 51 is positioned in an assembly holder 33. The first lens system 31 comprises two sub-systems, one for a light path 34 and one for a light path 35. The two sub-systems comprise a common lens L1 and a means for creating two light paths, in this example a half transparent mirror M1. The sub-system for light path 34 comprises a lens (or lens system) L3 and a recording device 41, in this example a CCD camera. By means of this sub-systems an aperture in the first electrode (G1) is recorded. The second optical sub-system (for light path 35) comprises a lens L4 and a recording device 42 (a CCD-camera). The second sub-system records the second aperture in the second electrode (G2). FIG. 3B shows the lens L1, which is positioned near the electrodes 20 (G1) and 24 (G2). Although the aperture B in the electrode 24 is positioned behind the aperture A in the electrode 20, and thus is invisible to the naked eye, it is nevertheless possible to record the aperture through lens L1 which is positioned near the aperture A. Typically the distance between the lens L1 and the aperture A is 4–15 mm.

The second lens system 32 comprises in this embodiment also two sub-systems, one for a light path 36 and one for a light path 37. The two sub-systems comprise a common lens L2 and a means for creating two light paths, in this example a half transparent mirror M2. The sub-system for light path 36 comprises a lens (or lens system) L5 and a recording device 43, in this example a CCD camera. By means of this sub-systems an aperture in the third electrode (grid 3) is recorded. The second optical sub-system (for light path 37) comprises a lens L6 and a recording device 44 (a CCD-camera) for recording the fourth aperture in the fourth electrode (grid 4). Recording the position of each of the apertures enables the relative positions of the three (or in this example four) or more apertures to be established. Alignment of the apertures can be established. The measurements can be used e.g. to remove assemblies of electrodes which do not meet pre-set quality standards from the production line, or as a quality check within a production line. Preferably the assembly of electrodes is rotated about an axis going approximately through the apertures. In FIG. 3A this is indicated by the rotational axis R. Recorded images of the apertures before and after the rotation about a common axis, namely the common rotational axis can be identified in each of the images. The optical systems could be rotated and/or the electron gun could be rotated, but preferably the electron gun is rotated while the optical systems are fixed, as this is simpler to implement. The rotation can be performed through e.g. twice an angle of 120°. Three images of each aperture can then be recorded. The common axis is then formed by the centre point of the triangle formed by the three images of each aperture. Preferably the rotation takes place through an angle of 180°. Two images of each aperture are recorded. The common rotational axis is formed by a point halfway between the two images. Since in each of the images of the apertures the common axis is identifiable, the deviation of this common axis is more accurately defined than without the rotation.

Preferably the electron gun and the optical systems are translated with respect to each other, and an image of each of the apertures is recorded prior to and after the translation. Because the absolute value of the translation is the same for each of the images it is possible to measure the scale in each of the images. This enables an improved determination of the relative positions of the apertures. In FIG. 3, possible translation directions x and y are indicated. The determination of the scale of the images can be further improved by translations in two or more directions, e.g. in the x as well as in the y-direction.

Figure 4A:
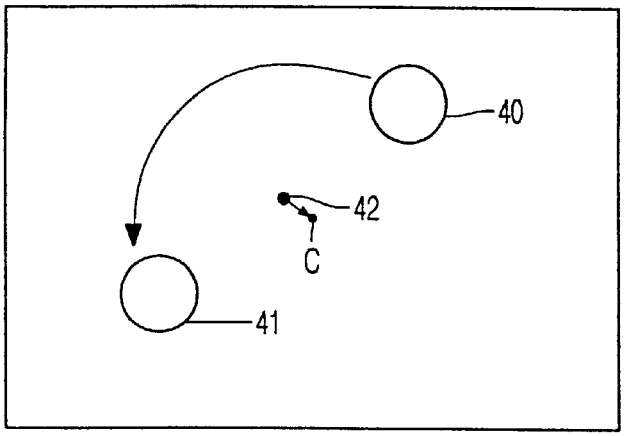
FIGS. 4A to 4C illustrate the effect of rotation of the assembly of electrodes on the measurements.
Figure 4B:
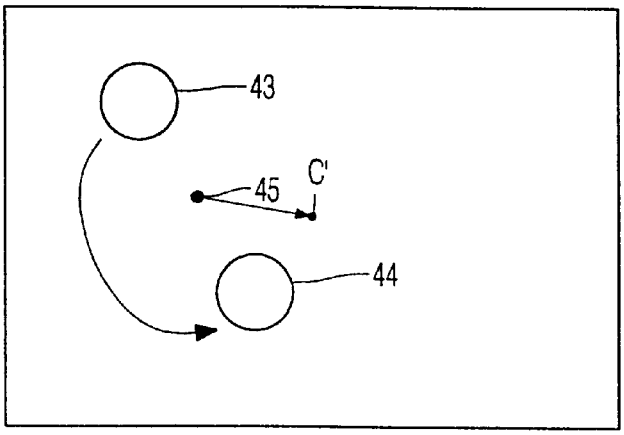
Figure 4C:
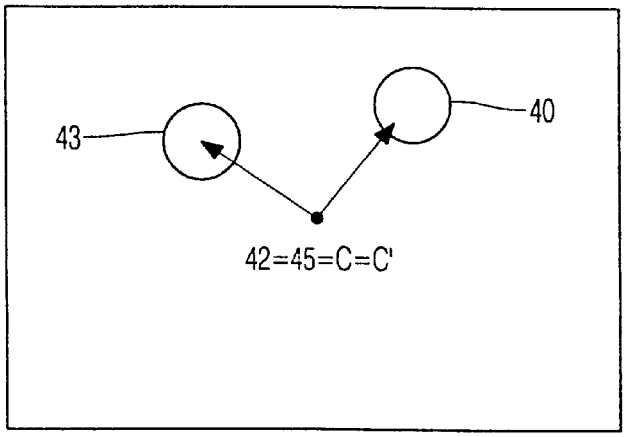

FIGS. 4A to 4C illustrate the effect of rotation on the measurement. FIG. 4A shows a recorded image of an aperture in the G1-electrode prior to (40) and after (41) rotation. The rotation R is indicated by an arrow, in this example the rotation is through an angle of 180°. The rotational axis is given by point 42 halfway between the areas 40 and 41.

FIG. 4B shows a recorded image of an aperture in the G2-electrode prior to (43) and after (44) rotation. The rotation R is indicated by an arrow, in this example the rotation is through an angle of 180°. The rotational axis is given by point 45 halfway between the areas 43 and 44.

These method steps can also be used to calibrate the recording devices in an initializing method step. The points 42 and 45 correspond to a common rotational axis. Therefore in the recording device which records the apertures A the centre C of the recorded image does not correspond with the rotational axis, but is slightly offset the right and downward (see FIG. 4A). In the recording device which records the apertures B, the centre C' of the recorded image does not correspond with the rotational axis, but is offset to the right and downward (see FIG. 4B). This information can be used to translate the recording devices over such a distance and in such a direction that the centres of the recorded images correspond to the rotational axis, or alternatively, this can be done electronically, i.e. when the two images of FIGS. 4A and 4B are compared in a computer, the images are so manipulated that the points 42 and 45 are "electronically" translated to the centre of the recorded images. The translation needed is indicated in FIG. 4A by an arrow. In either manner the resulting, compound image is an image as shown in FIG. 4C. The two method steps mentioned (rotation of the assembly) can be carried out for each assembly that is inspected. This would lead to a very accurate yet time-consuming method. It is possible, and preferable, to use the above mentioned steps for an initialization of the recording devices. Once the relative positions of the centres of the recording devices vis-a-vis the common rotational axis are established, the recording devices may be shifted, either physically or electronically, so that the centres correspond to the common rotational axis.

FIG. 4C shows an image in which the two images of the two apertures prior to the rotation are displayed in one figure, the common rotational axis being made to correspond to the centre C of the image. This can most easily be done in a computing device which receives the recorded images of FIGS. 4A and 4B. It is clear that areas 40 and 43 are shifted with respect to the common rotational axis 42,45. FIG. 4C would also give the absolute deviations of the apertures vis-a-vis the common rotational axis, provided that the scale in FIGS. 4A and 4B is the same. The scale of the images however is known to be of a limited accuracy. The scale could be read from the size of the apertures, however, preferably the electron gun is translated with respect to the optical systems.

Figure 5A:
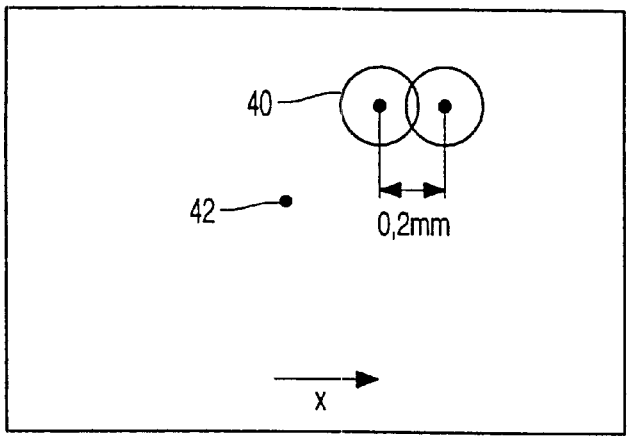
FIGS. 5A to 5C illustrate the effect of translation of the assembly of electrodes on the measurements.
Figure 5B:
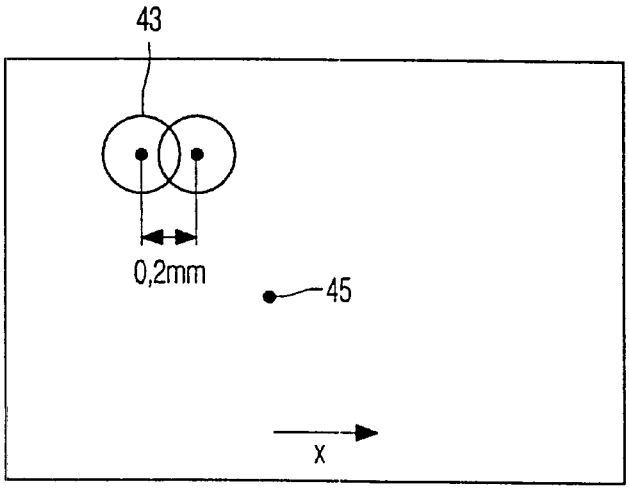
Figure 5C:
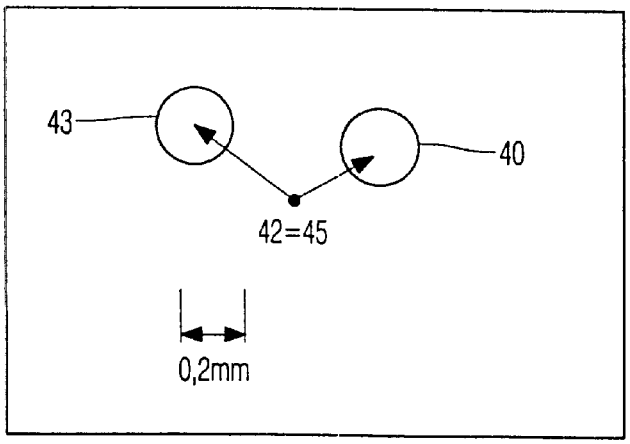

The effect of translation is illustrated in FIGS. 5A to 5C. In FIG. 5A two images are recorded of an aperture 40 in the G1-electrode, prior to and after a translation of 0.2 mm along the x-axis. In FIG. 5B two images are recorded of an aperture 43 in the G2-electrode, prior to and after a translation of 0.2 mm along the x-axis. The shift of the images provides a scale, as indicated in the figures. The scale can be determined for each assembly of electrodes that is inspected, but preferably the scale is determined in an initialization step. The scale is smaller in FIG. 5B than in FIG. 5A. This information can be combined with the information as shown in FIG. 4C to provide an accurate determination of the relative positions of the two apertures. FIG. 4C gives the direction of the deviation of the two apertures from the common axis 42, 45, and FIGS. 5A and 5B give the scale for each image. Combining the two gives a result as shown in FIG. 5C.

Figure 6:
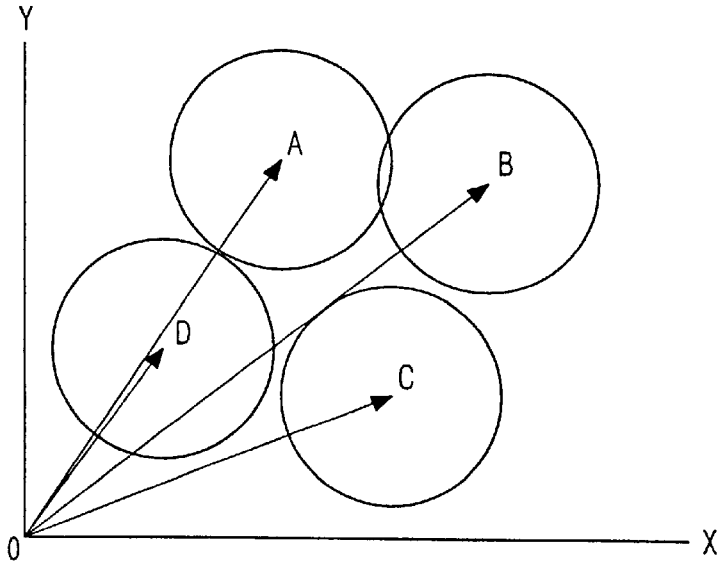
FIG. 6 shows, by means of an example, the deviation of four apertures from a common rotation axis.

FIG. 6 shows, by means of example, the deviation of four apertures A, B, C and D from a common rotation axis O. These positions can be compared with ideal positions to compare the measured positions to pre-set quality standards. All this can be done in a computing device which collects data from the recording devices.

Figure 7:
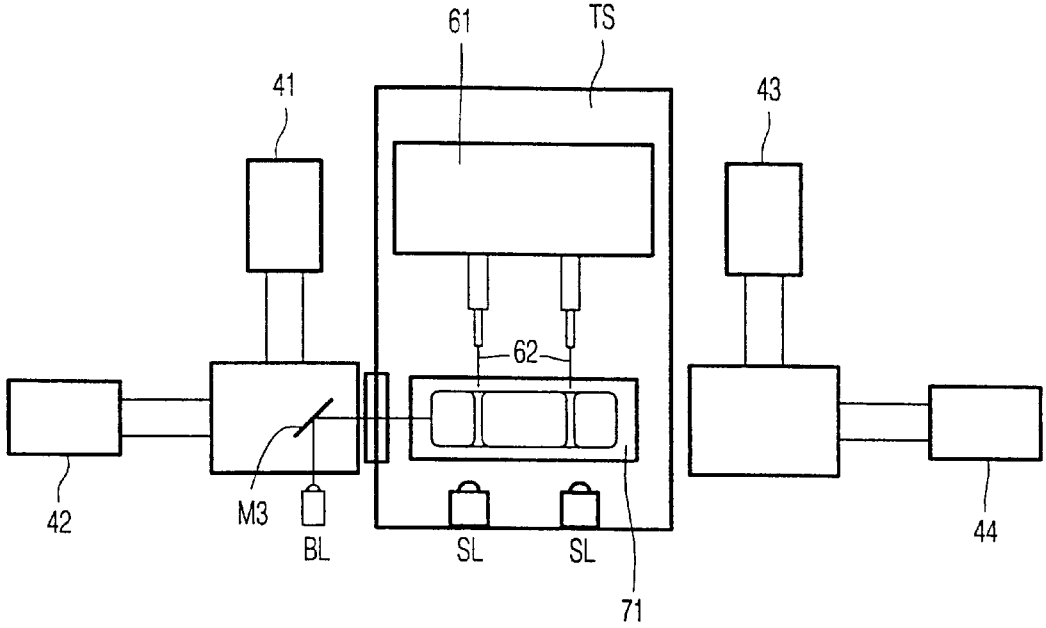
FIG. 7 shows further details of an embodiment of the method and device according to the invention.

FIG. 7 illustrates some further aspects of embodiments of the invention.

A translation device (TS) is indicated. Near the assembly of electrodes a means 61 is provided to position optical guides 62 in gaps between electrodes, for instance in the gap between the G3 and G4 and/or in the gap between the G2 and G3 electrode. Into these optical guides, which may be in the form of slides or sheets, light is coupled which is generated by lights sources SL (side light). The optical guides have means (for instance roughened surfaces) by which in operation light is coupled out of the light guide near an aperture and into said aperture. Preferably a diffuse light source is formed by such means. In this manner the apertures are well lit, which increases the quality of the images recorded, and thereby the accuracy of the determination of the positions. Furthermore a light source BL is provided, which, by means of a partially transparent mirror M3, illuminates on the apertures.

It will be apparent that within the framework of the invention many variations are possible. The invention can, for instance, be used for inspecting an electron generating a single electron beam, or for an in-line electron gun. In the latter case three determinations can be made, one for each of the electron beams. To make such an inspection possible the device may comprise a translation device 71 for translating an assembly such that the apertures for different electron beams are sequentially inspected. In the example the relative positions of four apertures are determined. By using more light paths, for instance by placing an extra halfway mirror in one of the light paths, thus diverting part of the light to yet another lens-camera system, more than two apertures can be measured with each optical system 31, 32. The positions in the x- and/or the y-direction, i.e. transverse to the propagation direction of the electron beams, can be determined. However, it is also possible (by moving a lens or a set of lenses) to determine the position in the z-direction, i.e. along the propagation direction of the electron beams.

We claim:

1. Method of manufacturing a cathode ray tube comprising an electron gun having a number of electrodes with apertures for passing at least one electron beam, in which method during a method step an assembly of electrodes is inspected, characterized in that the assembly of electrodes is positioned between a first and a second optical system and that the positions of a first and a second aperture of a first and a second electrode of the assembly are determined by means of the first optical system, and a position of a third aperture of a third electrode is determined by means of the second optical system.

2. Method as claimed in claim 1, characterized in that the position of a fourth aperture in a fourth electrode of the electron gun is determined by the second optical system.

3. Method as claimed in claim 2, characterized in that the second optical system comprises two optical sub-systems, which two sub-systems have a lens system, positioned near the apertures, and a partially transparent mirror in common, each optical sub-system further having a further lens system and a recording device to record an optical image of the relevant aperture.

4. Method as claimed in claim 1, characterized in that the first optical system comprises two optical sub-systems, which two sub-systems have a lens system, positioned near the apertures, and a partially transparent mirror in common, each optical sub-system further having a further lens system and a recording device to record an optical image of the relevant aperture.

5. Method as claimed in claim 1, characterized in that the method comprises a first and a second recording step in which images of the apertures are recorded by the recording devices, between which recording steps the electron gun is rotated, with respect to the optical systems, around an axis going approximately through the apertures.

6. Method as claimed in claim 1, characterized in that the method comprises a first and a second recording step in which images of the apertures are recorded by the recording devices, between which recording steps the electron gun is translated with respect to the optical systems.

7. Method as claimed in claim 1, characterized in that optical light guides are positioned in between electrodes, the optical light guides having means for coupling light out of the guide, near an aperture to be measured.

8. Device for inspecting an electron gun, characterized in that the device comprises a holder for an assembly of electrodes between a first optical system for inspecting a first and second aperture of an electron gun and a second optical system for inspecting a third aperture of an electron gun.

* * * * *